United States Patent [19]

Ledley

[11] 4,281,269

[45] Jul. 28, 1981

[54] MICROFOCUS X-RAY TUBE

[76] Inventor: Robert S. Ledley, 1002 Lagrande Rd., Silver Spring, Md. 20903

[21] Appl. No.: 87,374

[22] Filed: Oct. 23, 1979

Related U.S. Application Data

[63] Continuation-in-part of Ser. No. 791,328, Apr. 27, 1977, abandoned.

[51] Int. Cl.[3] ..... H01J 35/08

[52] U.S. Cl. ..... 313/60

[58] Field of Search ..... 313/60, 330

[56] References Cited

U.S. PATENT DOCUMENTS

| | | | |
|---|---|---|---|
| 2,298,335 | 10/1942 | Atlee | 313/330 |
| 3,290,540 | 12/1966 | Atti | 313/146 |
| 3,753,020 | 8/1973 | Zingaro | 313/60 |
| 3,825,786 | 7/1974 | Einighammer et al. | 313/60 |

*Primary Examiner*—Palmer C. Demeo
*Assistant Examiner*—Darwin R. Hostetter

[57] ABSTRACT

Disclosed is a reusable microfocus X-ray tube adapted to generate a relatively large number of X-rays in a relatively short period of time using a narrowly focused electron beam. The X-ray tube comprises means for producing a dense, narrow electron beam, a target anode, and means for moving the target anode so that it is stationary during production of the X-rays but a fresh portion of the surface of the target anode is presented to the electron beam each time the X-ray tube is used. The target anode is preferably in the form of a ribbon.

32 Claims, 2 Drawing Figures

MICROFOCUS X-RAY TUBE

CROSS-REFERENCE TO RELATED APPLICATION

This application is a continuation-in-part of application Ser. No. 791,328, filed Apr. 27, 1977, and abandoned upon the filing of this application.

BACKGROUND OF THE INVENTION

This invention relates to microfocus X-ray tubes such as are used to take medical X-rays. In such X-rays tubes, the electron beam is focused on an extremely small point on the target, which has the medical advantage that the X-ray silhouette is very clear and crisp. However, the highly dense, small spot of electrons quickly melts the target no matter what kind of cooling device is used, and therefore either the X-ray target is consumed in one use or fewer electrons are used in the beam than would otherwise be desirable. In particular, it is highly desirable in medical X-ray work to use an extremely short exposure time so that the motion of the patient or of the patient's inside organs does not smear the picture. However, with prior-art microfocus tubes, the exposure time must be relatively long to get enough X-rays to form the picture because the rate of X-ray production is so small.

The problems suggested in the preceding paragraph are not intended to be exhaustive, but rather are among many which tend to reduce the effectiveness of prior-art microfocus X-ray tubes. Other noteworthy problems may also exist; however, those presented above should be sufficient to demonstrate that microfilm X-ray tubes appearing in the prior-art have not been altogether satisfactory.

OBJECTS OF THE INVENTION

It is, therefore, a general object of the invention to provide a microfocus X-ray tube which will obviate or minimize problems of the type previously described.

It is a particular object of the invention to provide such a device which is reusable, yet which generates a relatively large number of X-rays in a relatively short period of time using a narrowly focused electron beam.

It is a further object of the invention to provide a microfocus X-ray tube wherein the X-ray tube comprises means for moving the target anode so that it is stationary during production of X-rays but a fresh portion of the surface of the target anode is presented to the electron beam each time the X-ray tube is used.

It is another object of the invention to provide a microfocus X-ray tube wherein the target anode is in the form of a ribbon.

Other objects and advantages of the present invention will become apparent from the detailed description of a preferred embodiment given hereinafter taken in conjunction with the accompanying drawings.

DESCRIPTION OF THE PRIOR ART

Many X-ray tubes of the type used in taking medical X-rays are known which employ more or less elaborate devices to move the target anode during impingement of the electron beam, thereby distributing the heat generated by the electron beam over a portion of the surface of the target anode far in excess of the cross-sectional area of the electron beam. Representative of the awkward designs others skilled in the art have resorted to to remove and deconcentrate the heat generated by the action of the electron beam on the target material is the device disclosed in U.S. Pat. No. 3,825,786, issued July 23, 1974, to Einighammer et al.

Many other X-ray tubes of the type used in taking medical X-rays are known in which similarly elaborate devices are employed to bring a cooling fluid into thermal contact with the target anode during impingement of the electron beam. The cooling fluid may, for example, be water or air.

Other types of X-ray tubes not suitable for use in taking medical X-rays, but suitable for use in X-ray crystalography, are known in which the target anode can be moved between impingements of the electron beam. Typical of these are the devices shown in U.S. Pat. No. 2,298,335, issued Oct. 13, 1942, to Atlee, and U.S. Pat. No. 3,753,020, issued Aug. 4, 1973, to Zingaro. Such devices, however, include a plurality of separate target anodes made of different materials, and the devices permit the operator to alternate from one target anode to another to obtain different readings from the different types of anodes. However, they do not cause the automatic substitution of one target anode for another after each use, and the operator could (and in many cases would) use the same segment of the same target anode many times before switching to a different target anode. Moreover, devices such as are disclosed in Atlee and Zingaro do not cause a different portion of each target anode to be used each time the user returns to a given target anode. If a fresh portion of the target anode is presented to the electron beam when a given target anode is used on a subsequent occasion, it would be accidental or incidental, not caused deliberately and consistently.

Finally, U.S. Pat. No. 3,290,540, issued Dec. 6, 1966, discloses an electron discharge tube having a movable cathode tape. The tape serves as an emissive element, and the tape can be incremented after it has become pitted from use. However, the pitting of an emissive cathode from use is very different, both physically and conceptually, from the melting of a portion of a target anode due to the impingement of an electron beam.

THE DRAWINGS

DETAILED DESCRIPTION OF THE PRESENTLY PREFERRED EMBODIMENT

Figure 1:
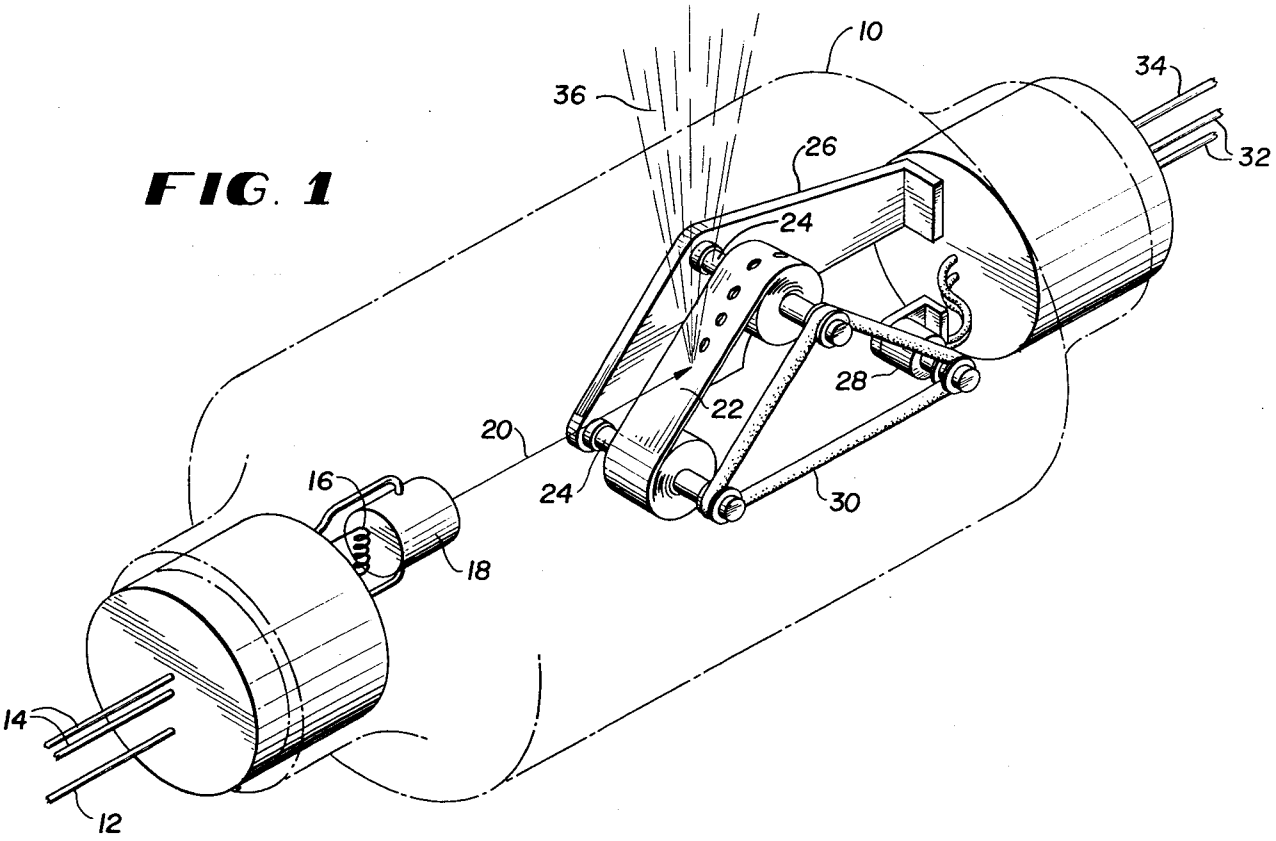
FIG. 1 is a perspective view of the presently preferred embodiment of an X-ray tube according to the invention.

The presently preferred embodiment of the subject invention comprises a conventional evacuated glass envelope 10 and a high voltage line 12, filament current wires 14, a heater cathode 16, and an electron beam collimator 18 which together constitute means for producing a dense, narrow electron beam 20. Instead of the conventional conical target anode, however, the subject X-ray tube preferably has a target anode in the form of a ribbon 22 trained around two spools 24 mounted within the X-ray tube on bracket 26. The ribbon 22 is preferably made of tungsten, but in any event the working surface of the ribbon 22 is made of a single anode material.

Also mounted within the X-ray tube is a stepping motor 28 which is operatively connected to the spools 24 via a drive belt 30. Power for the motor 28 is supplied by motor wires 32, and the motor 28 and the target anode 22 are gounded by ground wire 34.

The roughened portions of the ribbon 22 caused by impingement of the electron beam 20 are, of course, greatly exaggerated in size for clarity. In fact, the roughened portions are approximately 50 microns in diameter, and their center-to-center distance (i.e., the amount by which the stepping motor 28 increments the ribbon 22 each time it is actuated) is approximately 100 microns.

In use, activation of the heater cathode 16 and the motor 28 is coordinated so that the ribbon 22 is stationary during production of X-rays 36, but a fresh portion of the surface of the ribbon 22 is presented to the electron beam 20 each time the X-ray tube is used. Each use of the X-ray tube therefore melts at least the surface portion of the spot on the ribbon 22 on which the electron beam 20 is focused, but the ribbon 22 is then moved on by a short distance, much in the fashion of a typewriter ribbon, before the X-ray tube is used again.

Figure 2:
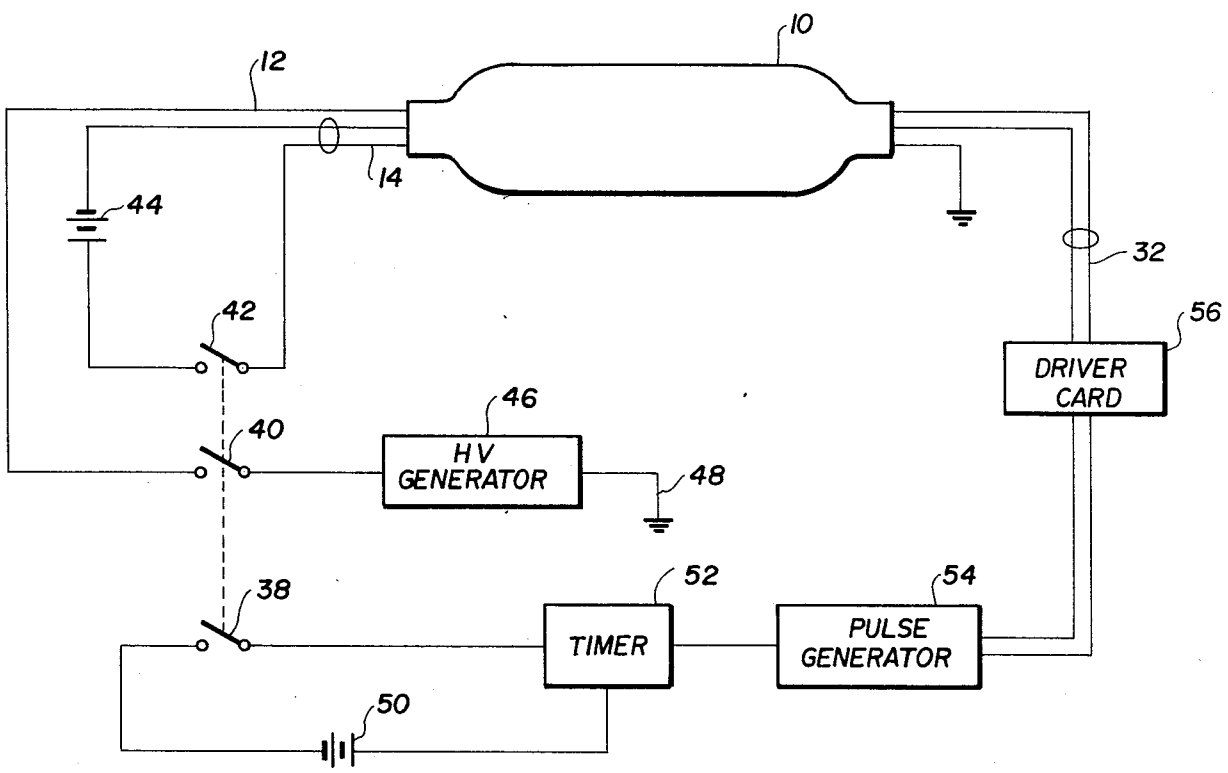
FIG. 2 is a schematic diagram of control means for the X-ray tube shown in FIG. 1.

FIG. 2 shows in schematic form exemplary means for coordinating the electron producing means and the ribbon advancing means. Such means comprise three ganged switches 38, 40, and 42 and three circuits, one of which is controlled by each of the switches. The ganged switches may be operated simultaneously by a single push button (not shown). One of the three circuits comprises a voltage source 44, the switch 42, and the filament current wires 14. Another of the three circuits comprises a high voltage generator 46 grounded at 48, the switch 40, and the high voltage line 12. Since these circuits are conventional, they will not be described further. The third circuit, however, is not conventional, for it is the circuit which coordinates the first two circuits and the stepping motor 28. It comprises the switch 38, a battery 50 (which may be the same as battery 44), a timer 52, which may for instance be a two second timer, a pulse generator 54, a driver card 56, and motor wires 32.

Activation of the ganged switches 40 and 42 causes generation of an electron beam lasting less than 1/10 of a second in the conventional manner. Simultaneously, actuation of the switch 38 actuates the two-second timer 52. After elapse of the two seconds, the pulse generator 54 emits a pulse which actuates the driver card 56, and the driver card 56 causes the stepping motor 28 to increment. The increment of the stepping motor 28 may, for instance, be 1.8°, and the spools 24 and the take-off spool connected to the stepping motor 28 are sized so that a 1.8° increment of the stepping motor causes the ribbon 22 to advance by approximately 100 microns. Since the time elapse between X-rays is much more than two seconds, the illustrated apparatus insures that a fresh portion of the surface of the ribbon 22 is presented to the electron beam upon each actuation of the beam.

Although not illustrated, it is within the contemplation of the invention for the target anode to take on shapes other than the illustrated ribbon shape. It may, for instance, be in the shape of a wheel or a cone. No matter what its shape, however, the common feature of the invention is that the target is moved intermittently to present a new target area for each shot, but remains stationary during each shot.

ADVANTAGES OF THE INVENTION

From the foregoing description of a microfocus X-ray tube in accordance with a preferred embodiment of the invention, those skilled in the art will recognize several advantages which singularly distinguish the subject invention from previously known devices. Some of those advantages are set forth below. However, while the following list of advantages is believed to be both accurate and representative, it does not purport to be exhaustive.

A particular advantage of the subject invention is that it is reusable, yet it generates a relatively large number of X-rays in a relatively short period of time from a narrowly focused electron beam.

Another advantage of the subject invention is that it produces X-ray silhouettes which are very clear and crisp. In particular, since the X-ray silhouettes are made in a short time exposure, motion of the patient's organs does not smear the picture.

CAVEAT

While the present invention has been illustrated by a detailed description of a preferred embodiment thereof, it will be obvious to those skilled in the art that various changes in form and detail can be made therein without departing from the true scope of the invention. Accordingly, the invention must be measured by the claims appended thereto and not by the foregoing preferred embodiment.

I claim:

1. A reusable microfocus X-ray tube adapted to generate a relatively large number of X-rays in a relatively short period of time using a narrowly focused electron beam, said microfocus X-ray tube comprising:

(a) first means for producing a dense, narrow electron beam;

(b) a target anode; and (c) second means for moving said target anode so that it is stationary during production of X-rays but a fresh portion of the surface of said target anode is presented to the electron beam each time the X-ray tube is used.

2. A microfocus X-ray tube as recited in claim 1 wherein said target anode is in the form of a ribbon.

3. A microfocus X-ray tube as recited in claim 2 wherein said target anode is made of tungsten.

4. A microfocus X-ray tube as recited in claim 2 wherein said target anode is trained around a plurality of spools mounted within the X-ray tube.

5. A microfocus X-ray tube as recited in claim 4 wherein said second means comprises a motor mounted within the X-ray tube and operatively connected to at least one of said spools.

6. A microfocus X-ray tube as recited in claim 1 wherein said target anode is made of tungsten.

7. A microfocus X-ray tube as recited in claim 1 wherein the working surface of said target anode is made of a single anode material.

8. A microfocus X-ray tube as recited in claim 1 wherein said second means moves said target anode by a short distance between uses of the X-ray tube, whereby the used portions of said target anode are closely spaced.

9. In a microfocus X-ray tube comprising:

(a) first means for producing a dense, narrow electron beam and (b) a target anode, the improvement wherein:

(c) the X-ray tube further comprises second means for moving said target anode so that it is stationary during production of X-rays but a fresh portion of the surface of said target anode is presented to the electron beam each time the X-ray tube is used, whereby a relatively large number of X-rays can be generated in a relatively short period of time using a narrowly focused electron beam without destroying the X-ray tube.

10. A microfocus X-ray tube as recited in claim 9 wherein said target anode is in the form of a ribbon.

11. A microfocus X-ray tube as recited in claim 10 wherein said target anode is made of tungsten.

12. A microfocus X-ray tube as recited in claim 10 wherein said target anode is trained around a plurality of spools mounted within the X-ray tube.

13. A microfocus X-ray tube as recited in claim 12 wherein said second means comprises a motor mounted within the X-ray tube and operatively connected to at least one of said spools.

14. A microfocus X-ray tube as recited in claim 9 wherein said target anode is made of tungsten.

15. A microfocus X-ray tube as recited in claim 9 wherein the working surface of said target anode is made of a single anode material.

16. A microfocus X-ray tube as recited in claim 9 wherein said second means moves said target anode by a short distance between uses of the X-ray tube, whereby the used portions of said target anode are closely spaced.

17. A method of generating a relatively large number of X-rays in a relatively short period of time using a re-usable microfocus X-ray tube comprising means for producing a dense, narrow electron beam and a target anode, said method comprising the step of moving the target anode so that it is stationary during production of X-ray but a fresh portion of the surface of the target anode is presented to the electron beam each time the X-ray tube is used.

18. A method as recited in claim 17 wherein said target anode is moved by a short distance between uses of the X-ray tube, whereby the used portions of the target anode are closely spaced.

19. A method as recited in claim 17 wherein the working surface of said target anode is made of a single anode material.

20. A reusable microfocus X-ray tube for taking medical X-rays, said microfocus X-ray tube of a type to generate a relatively large number of X-rays in a relatively short period of time using a narrowly focused electron beam, said microfocus X-ray tube comprising:

(a) first means for producing a dense, narrow electron beam;

(b) a target anode;

(c) second means for moving said target anode; and (d) third means for coordinating said first and second means so that said target anode is stationary during production of X-rays and a fresh portion of the surface of said target anode is presented to the electron beam upon each actuation of said beam.

21. A microfocus X-ray tube as recited in claim 20 wherein said target anode is in the form of a ribbon.

22. A microfocus X-ray tube as recited in claim 20 wherein said target anode is made of tungsten.

23. A microfocus X-ray tube as recited in claim 20 wherein the working surface of said target anode is made of a single anode material.

24. A microfocus X-ray tube as recited in claim 20 wherein said third means causes said target anode to move by a short distance between uses of the X-ray tube whereby the used portions of said target anode are closely spaced.

25. In a microfocus X-ray tube for taking medical X-rays, said microfocus X-ray tube comprising:

(a) first means for producing a dense, narrow electron beam;

(b) a target anode; and (c) second means for moving said target anode, the improvement wherein the X-ray tube further comprises:

(d) third means for coordinating said first and second means so that said target anode is stationary during production of X-rays and a fresh portion of the surface of said target anode is presented to the electron beam in each instance the X-ray tube is used, whereby a relatively large number of X-rays can be generated in a relatively short period of time using a narrowly focused electron beam without destroying the usefulness of the X-ray tube.

26. The microfocus X-ray tube recited in claim 25 wherein said third means causes said target anode to move by a short distance between uses of the X-ray tube, whereby the used portions of said target anode are closely spaced.

27. A microfocus X-ray tube as recited in claim 25 wherein said target anode is in the form of a ribbon.

28. A microfocus X-ray tube as recited in claim 25 wherein said target anode is made of tungsten.

29. A microfocus X-ray tube as recited in claim 25 wherein the working surface of said target anode is made of a single anode material.

30. A method of generating a relatively large number of X-rays in a relatively short period of time for use in taking medical X-rays using a re-usable microfocus X-ray tube comprising:

(a) first means for producing a dense, narrow electron beam;

(b) a target anode; and (c) second means for moving said target anode, said method comprising the step of coordinating said first and second means so that said target anode is stationary during production of X-rays, but a fresh portion of the surface of said target anode is presented to the electron beam each time the X-ray tube is used.

31. A method as recited in claim 30 wherein said target anode is moved by a short distance between uses of the X-ray tube, whereby the used portions of the target anode are closely spaced.

32. A method as recited in claim 30 wherein the working surface of said target anode is made of a single anode material.

* * * * *